US005855099A

United States Patent [19]

Hoffman

[11] Patent Number: 5,855,099

[45] Date of Patent: Jan. 5, 1999

[54] SECTIONAL STORM PANEL ASSEMBLY

[76] Inventor: Robert E. Hoffman, 5618 Riviera Dr., Coral Gables, Fla. 33146

[21] Appl. No.: 818,302

[22] Filed: Mar. 14, 1997

[51] Int. Cl.[6] ..... E06B 9/02

[52] U.S. Cl. ..... 52/202; 52/537; 52/798.1; 52/800.13; 52/800.18; 52/741.3; 52/745.16; 52/DIG. 12; 49/57

[58] Field of Search ..... 52/202, 537, 783.11, 52/783.12, 798.1, 800.12, 800.13, 800.18, 741.3, 745.1, 745.16, DIG. 12, DIG. 15; 49/57, 61, 62, 464

[56] References Cited

U.S. PATENT DOCUMENTS

| | | | |
|---|---|---|---|
| 140,526 | 7/1873 | Munson, Jr. | 52/783.11 |
| 2,568,195 | 9/1951 | Jones | 49/464 |
| 4,333,271 | 6/1982 | DePaolo et al. | 49/464 |
| 4,726,149 | 2/1988 | Tryba | 49/465 |
| 5,347,775 | 9/1994 | Santos | 52/202 |
| 5,426,893 | 6/1995 | Hoffman | 52/202 |
| 5,487,243 | 1/1996 | Hale et al. | 49/464 X |
| 5,487,244 | 1/1996 | Hill | 52/202 |
| 5,540,018 | 7/1996 | Biggers | 52/202 |
| 5,579,615 | 12/1996 | Hoffman | 52/202 |
| 5,596,849 | 1/1997 | Hill | 52/202 |
| 5,603,190 | 2/1997 | Sanford | 52/202 |
| 5,651,221 | 7/1997 | Golen | 52/202 |
| 5,722,206 | 3/1998 | McDonald | 52/202 |

*Primary Examiner*—Carl D. Friedman
*Assistant Examiner*—Laura A. Callo
*Attorney, Agent, or Firm*—Harness Dickey & Pierce, PLC

[57] ABSTRACT

A sectional storm panel for covering an opening in a building is formed of a plurality of vertically elongated, narrow, corrugated panel sections that are manually assembled, in edge to edge relationship, from the interior of the building, from each side edge of the opening towards the opposite side edge to form a pair of co-planar panel portions that are spaced apart. The space between the panels is covered by a separate cover section that is inserted through the space, from the interior of the building to the outside of the building, and then positioned manually so that its vertical edges overlap the adjacent panel section vertical edges that define the space between the panel sections. The sections extend between a lower rail and an upper rail secured to the lower and upper edges of the opening, respectively. Removable mechanical fasteners are manually applied, from the interior of the building, to fasten the sections to the lower rail as they are assembled to form the panel portions and to secure the cover section in its place.

14 Claims, 3 Drawing Sheets

FIG-1
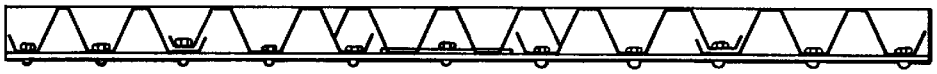
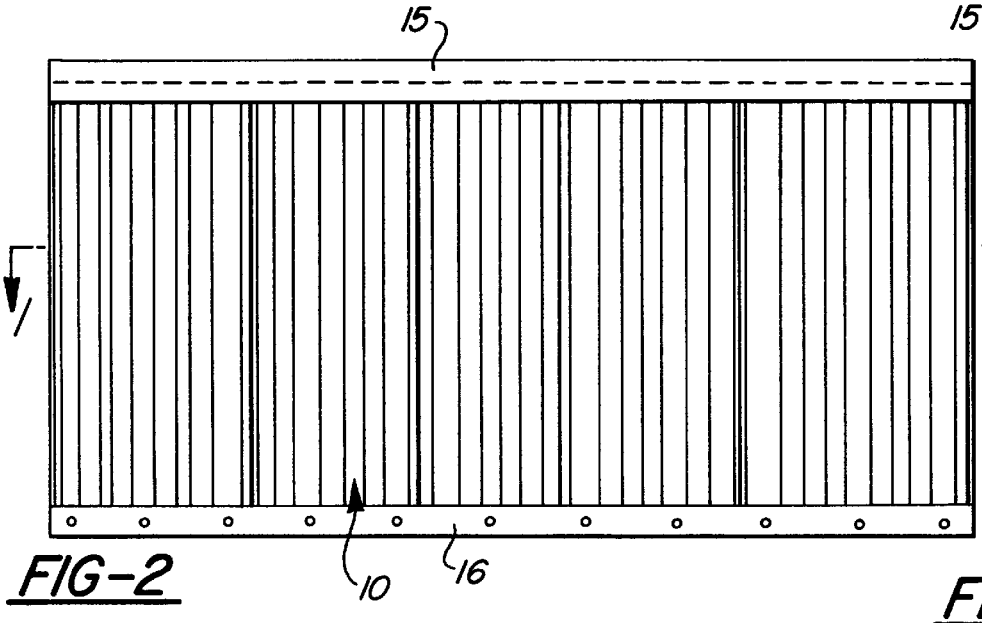
FIG-2
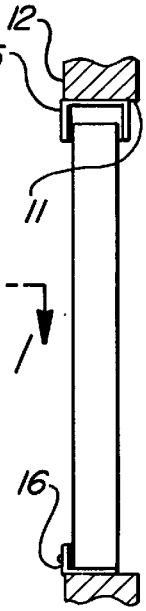
FIG-3
FIG-4
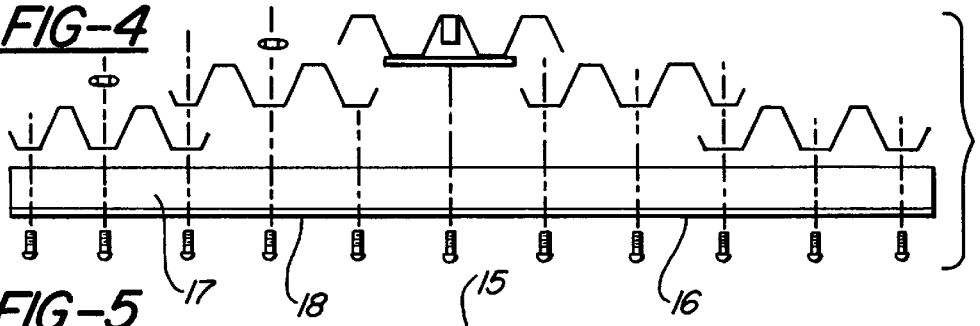
FIG-5
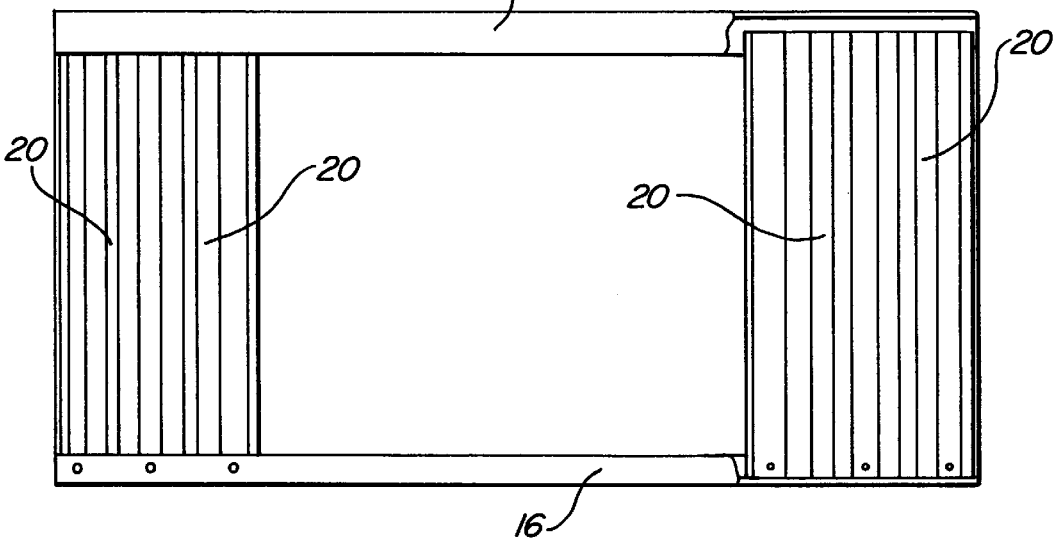

SECTIONAL STORM PANEL ASSEMBLY

BACKGROUND OF INVENTION

This invention relates to a sectional storm panel which is assembled over the opening in a building to prevent penetration by objects that are propelled by high winds during storms.

In areas which are subject to severe wind storms, such as hurricanes and the like, it is common to cover window openings with storm panels when a storm warning is received so that when the storm actually arrives, the building is protected against the entry of objects that are carried by the wind. In addition, such storm panels can be used to protect a building from unauthorized entry through the building openings.

Sectional storm panels may be formed of a number of vertically elongated panel sections that are assembled over the building opening, in approximate edge to edge overlapping relationship, in a common plane to form a large panel. The panel is positioned over a window or doorway or porch entry or the like of a building. The individual sections may be made of corrugated steel sheets. The upper and lower edges of the panel sections may be abutted against, and secured to, a lower sash-type rail extending across the lower edge of the opening and an upper lintel-type rail extending across the upper edge of the opening. Thus, by forming a storm panel out of separate sections that are assembled together to form the composite panel, the storm panel may be more easily stored, when not in use, and may be manually lifted and positioned over the building opening, when necessary, by an individual workman or homeowner. An example of this type of sectional storm is disclosed in my prior U.S. Pat. No. 5,579,615, issued Dec. 3, 1996 and entitled "Sectional Storm Panel."

One problem that arises in assembling sectional storm panels is that the sections normally are applied from the outside of the building over the opening to be protected. Fasteners such as screws or bolts are normally applied from the exterior of the building by the person assembling the storm panel. Hence, where that person can stand on the ground, that is, where the opening is near the ground or near a floor-like surface, such as a porch, the assembly can be rapidly and conveniently performed. However, where the opening is high, relative to the ground or floor, the assembler can reach the opening and apply the sections only by standing upon a ladder or scaffold or the like. In such cases, the assembly is awkward and requires more time and care. In addition, it is relatively dangerous in that the assembler can accidently fall to the ground and become injured.

Therefore, it would be desirable to provide a sectional storm panel which may be assembled from the inside of the building. That is, it would be desirable to enable a person who is assembling the panel sections to stand inside of the building, facing outwardly of the opening, while assembling the sections, one by one, upon the outside of the building.

This present invention relates to a method and a sectional panel construction which can be assembled on the outside of a building opening by a single workman or by a homeowner standing inside the building.

SUMMARY OF INVENTION

This invention contemplates providing a sectional storm panel made of a plurality of substantially identical, corrugated metal panel sections that are assembled together, overlapping edge-to-edge, in a generally common plane and engaged at their upper and lower ends to upper and lower rails secured at the upper and lower edges of the opening to be covered. The sections are applied by a person standing inside the building at the opening to be covered, by inserting each panel section through the opening to the outside of the building and then positioning the section over the opening with its upper and lower edges abutting the respective rails. The assembly is performed, section-by-section, starting first at one vertical side edge of the opening to form a partially assembled panel portion that extends from that opening side toward the center of the opening. Next, a similar partially assembled panel portion is formed by assembling panel sections from the opposite vertical edge of the opening towards the center. Thus, the person assembling the panel sections can apply removable mechanical fasteners, such as bolts with wing nuts, through at least the lower rail and the lower edges of the panel sections for fastening them in place.

Upon formation of the two partially assembled panel portions, a gap or space is left between them. The gap is covered by a separate cover section. This cover section may be of approximately the same size and shape as the panel sections or may be of a pre-determined width, but of the same height as the panel sections. The interior surface of the cover section is provided with a suitable handle or grip for manually holding and maneuvering the cover section through the gap, from the inside of the building to the outside. Then the cover section is retracted back, toward the inside of the building, to cover the gap from the outside of the building. That is, the side edges of the cover section overlap the outside surfaces of the adjacent side edges of the two panel portions. The cover section is then manually secured with removable fasteners to at least the lower rail and, if desired, to the upper rail. In that manner, the assembled panel is positioned over the outside surface of a window or door opening by a person standing inside of the building on a floor adjacent the opening. Similarly, the panel can be removed in the same way.

An object of this invention is to provide a sectional storm panel, which is made of a plurality of panel sections, that can be manually positioned and secured in place over a window or door opening by an assembler located inside the building.

Another object of this invention is to provide a simplified method for speedily assembling a sectional storm panel by a single assembler who is located inside the building, with minimal effort and, likewise, to enable disassembly of the storm panel from the inside of the building by a single person.

Still a further object of this invention is to provide a relatively inexpensive, easily assembled and easily stored, sectional storm panel for covering a building opening in minimal time, by one person, located within a building, without the necessity of having to utilize ladders or scaffolding or the like to reach openings that are located above the ground level of the building.

Yet another object of this invention is to provide a sectional storm panel assembly, which can be assembled and disassembled by a single person located inside a building, which is sufficiently strong to provide protection against wind-hurled objects penetrating the building through the openings.

These and others objects and advantages of this invention will become apparent reading the following description, of which the attached drawings form a part.

DESCRIPTION OF DRAWINGS

FIG. 1 is a top, cross-sectional view, of the assembled storm panel taken in the direction of arrows 1—1 of FIG. 2.

FIG. 2 is a front, elevational view, of the assembled storm panel.

FIG. 3 is a side view of the assembled storm panel and showing schematically, in cross-section, a portion of the building opening.

FIG. 4 is a top, plan view, schematically showing the positioning of the panel sections and cover sections.

FIG. 5 is a front, elevational view, with the upper and lower rails partially cut-away, showing the partially assembled panel portions.

DETAILED DESCRIPTION

Figure 6:
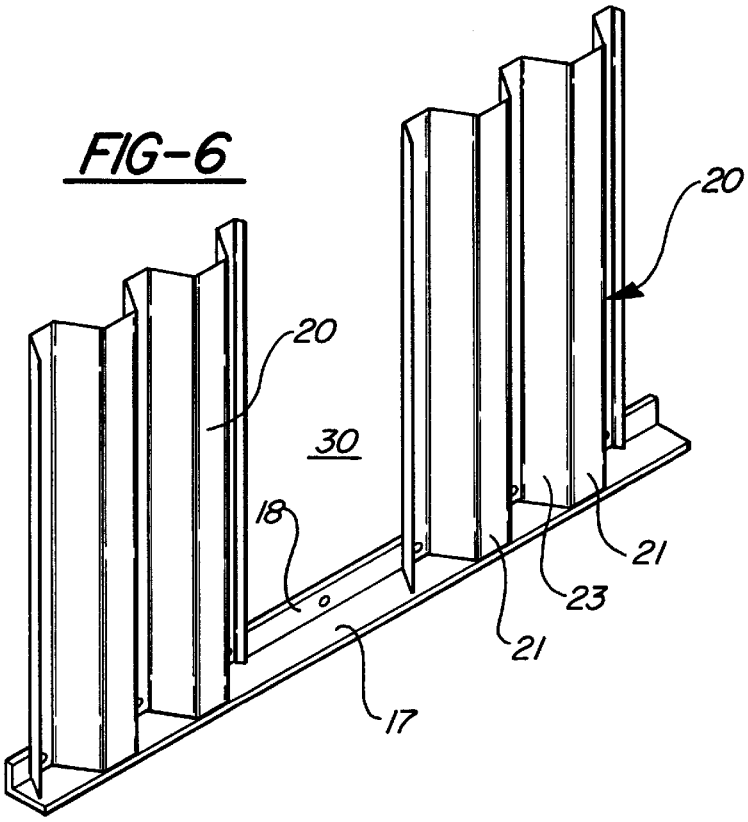
FIG. 6 is an enlarged, perspective view, showing the relative locations of the gapped or spaced apart panel sections arranged against the lower rail.

FIGS. 1–3 illustrate an assembled storm panel 10 which is formed of corrugated, sheet metal sections. The storm panel is of the size and shape to cover an opening 11 which is schematically indicated as being formed as a window in a building 12 (see FIG. 3). The size and shape of the assembled panel is sufficient to completely cover the opening, whether the opening is a window or a doorway or a patio door opening, or porch opening or the like, to prevent wind-hurled or thrown objects from penetrating the building through the opening.

A channel shaped upper rail 15 is secured to the lintel or upper edge of the opening, such as by screws (not shown) and may be left in place at all times. A right angle, in cross-section, shaped lower rail 16 may be arranged upon or adjacent to the sill of the opening. Depending upon the nature of the opening, the rails can be left in place at all times or, alternatively, removed and repositioned, when needed. For that purpose, suitable screws may be used to fasten the lower rail to the building portion which defines the lower edge of the opening. The lower rail has a horizontal leg 17 and a vertical leg 18.

The storm panel is made of an assembly of substantially identical, corrugated, sheet metal, panel sections 20. Preferably these sections are relatively narrow and are sufficiently tall to extend vertically over the opening. Each panel is preferably corrugated in a truncated triangular corrugation shape, forming a narrow apex or crown or small base 21, an open, large base 22 and angled legs 23. The vertical edges of each section terminate in partial leg or edge lip 24.

Figure 11:
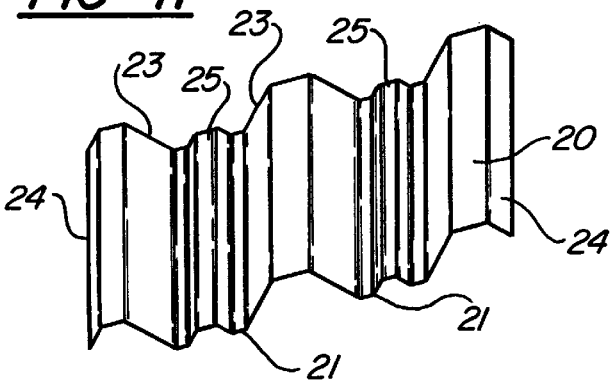
FIG. 11 is a perspective view of a portion of a section and illustrates bent channel formations formed in the corrugations for rigidifying the sections.
Figure 12:
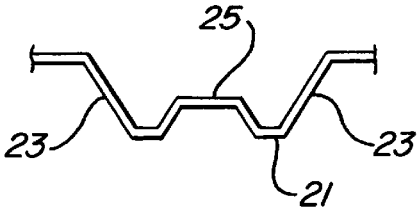
FIG. 12 is an enlarged, fragmentary, view of a fragment of a section and illustrating the depressed, bent channel formed in the surfaces of the crown or apex parts of the corrugations.

Preferably, the crowns or narrow apexes of the corrugations are indented or bent into continuous channels or troughs 21 (see FIGS. 11 and 12) to form a rigidifying formation at each corrugation.

The panel sections are assembled, one-by-one, by a person, such as workman or a homeowner, located on the inside of the building (which would be at the left side of FIG. 3), starting at the vertical side edges of the opening. Thus, the assembler first inserts a panel section through the opening and manipulates the section until its upper edge is fitted into the downwardly extending channel 15. The section is then lifted upwardly, further into the channel. The channel is deep enough to permit the section to be raised high enough so that its lower edge clears the vertical leg 18 of the lower rail. Once the lower edge of the section passes over the vertical leg 18 of the lower rail, the section is maneuvered to fit upon the horizontal 17 of the lower rail with the crowns of its corrugations abutted against the vertical leg 18. At that point, the assembler manually applies fastener bolts or screws 26 through the vertical leg 18, and through the abutting corrugation crowns and fastens the bolts in place with wing nuts 27 (see FIG. 4 and FIG. 10).

Having assembled the first panel section, the person conducting the assembly repeats the operation with the next panel section, as shown schematically in FIG. 4. This time, the second section is arranged to overlap the adjacent vertical edge of the first section. That assembly is repeated for the section in place with the fasteners. This is continued until a panel portion extends partially across the opening from one side edge towards the other.

At that point, the assembler repeats the assembling steps, but this time starting from the opposite side edge to assemble another panel portion extending toward the first panel portion. The second panel portion is assembled until the two, now generally co-planar panel portions, are spaced apart a pre-determined gap or space 30 (see FIGS. 4 and 6). To cover that gap or space, a separate, cover section is utilized.

Figure 7:
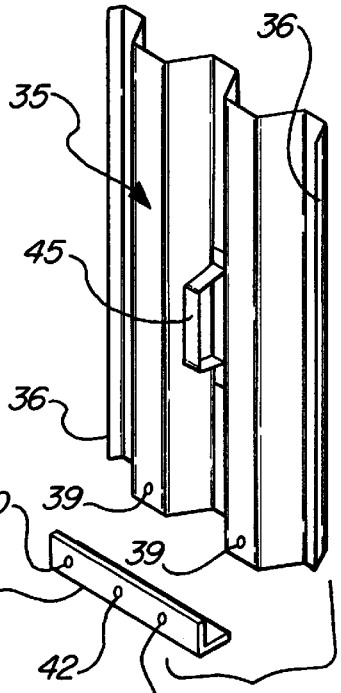
FIG. 7 is a perspective view of the lower portion of the cover section and with its reinforcing angle strip disassembled.

The cover section 35 (see FIGS. 6 and 7), is formed with the same corrugations and corrugation indentations as mentioned above, in connection with the panel sections. In addition, the cover section has edge flanges 36 which are about the same as the edge lips 24 except, optionally, they may be of a greater width.

Figure 8:
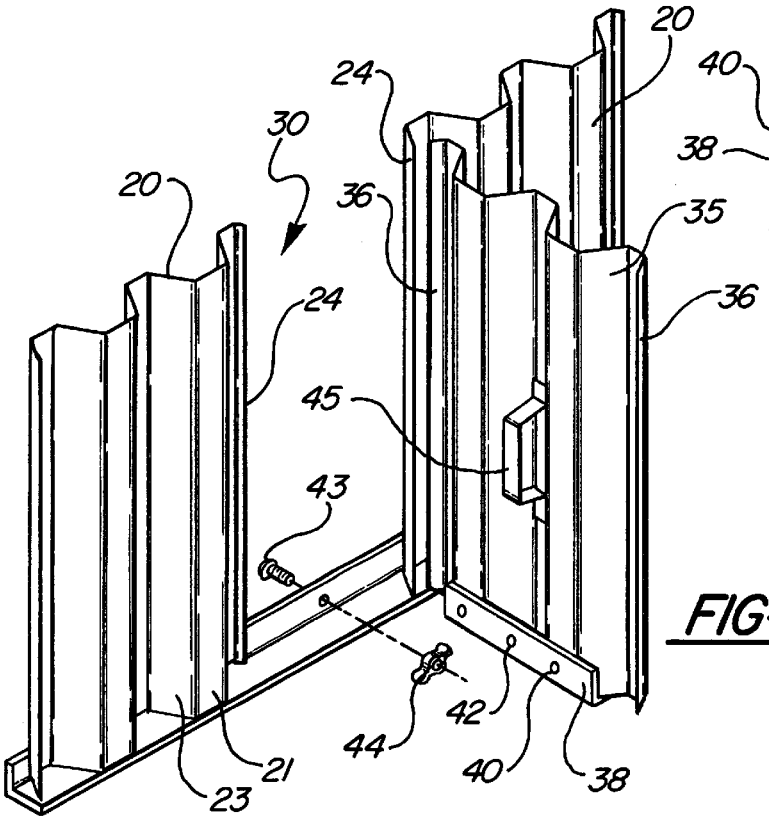
FIG. 8 is a perspective, fragmentary view of the lower portions of the spaced-apart panel portions and with the cover section being positioned for assembly to cover the space or gap between the panel portions.

An angle strip, formed of rigid metal 38 (see FIGS. 7 and 8) is secured to the lower edge of the corrugated cover section. For that purpose, holes 39 may be preformed in the lower edge of the cover section and similar holes 40 are formed in the strip 38. Rivets or metal screws 41 (see FIGS. 8 and 10) are passed through the aligned holes 39 and 40 to permanently fasten the strip 38 to the cover section 35.

Figure 10:
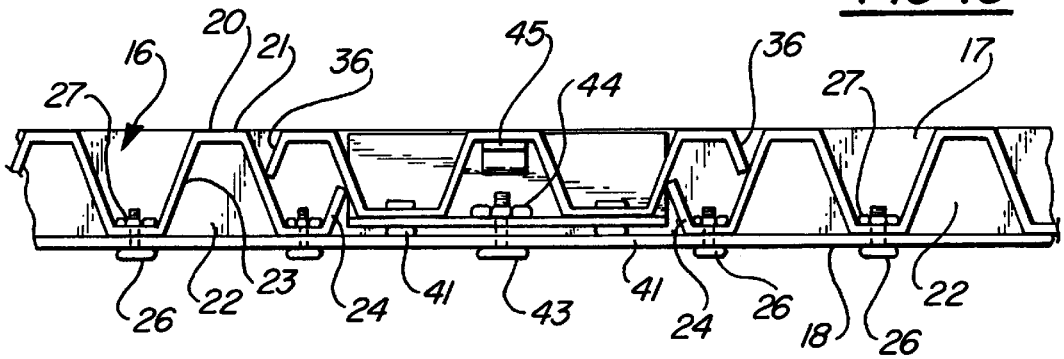
FIG. 10 is a plan, fragmentary, cross-sectional view showing the position of the cover section relative to the adjacent panel sections when fastened in place with removable fasteners.

The strip 38 also has at least one hole 42 to receive a bolt 43 which is secured by a wing nut 44 for fastening the strip against the vertical leg 18 of the lower rail (see FIG. 10).

Figure 9:
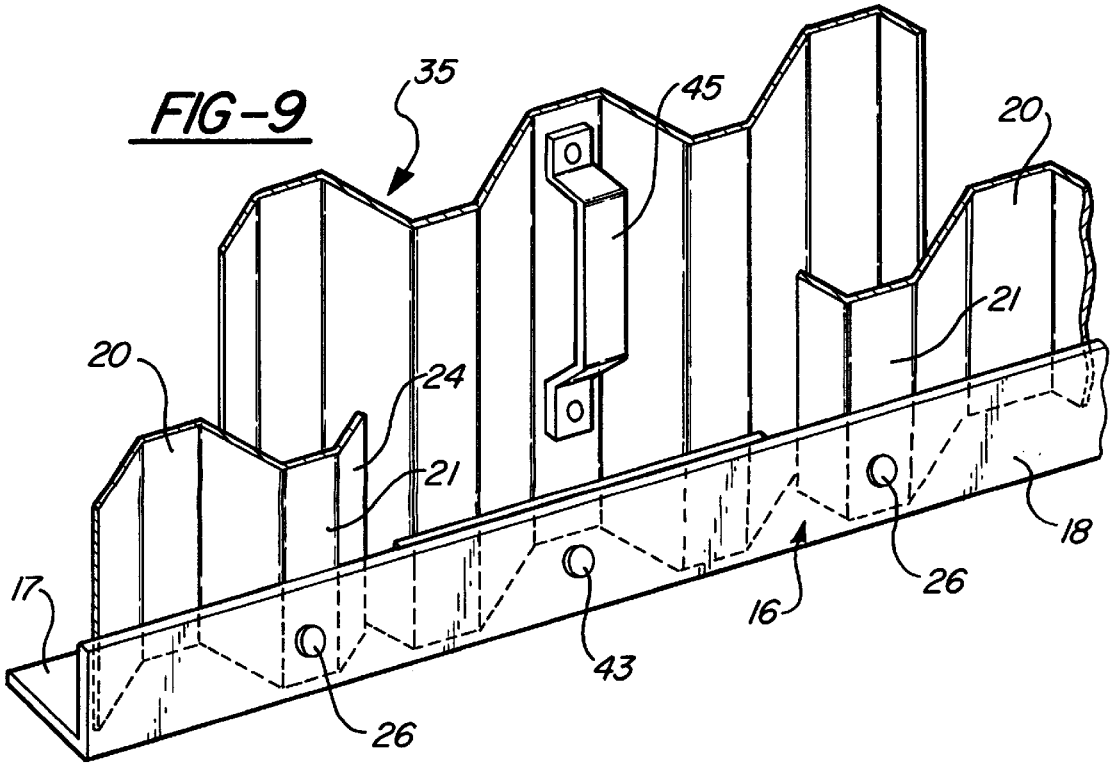
FIG. 9 is a fragmentary, perspective view, of the lower parts of the cover section arranged over the opening and overlapping the adjacent edges of the panel sections forming the panel portions, and the fastening of the sections to the lower rail.

The cover section is applied by the assembler (who is located inside of the building) by grasping the cover section and, also, grasping one or more hand grips or handles 45 that are fastened on the interior surface of the cover section. Then, the cover section is maneuvered through the gap 30 to the outside of the building and then retracted, by pulling it back over the gap towards the building, so that its vertical edges overlap the adjacent vertical edges of the adjacent sections (see FIGS. 9 and 10). At that point, the bolt 43 which is located on the inside of the building, that is, on the inside surface of the vertical leg 18, is passed through the bolt hole 42 and the wing nut 44 is manipulated by the assembler for securing the cover section to the assembly.

By following the foregoing steps, the complete storm panel can be assembled by a single person standing on the floor on the inside of the building next to the opening being covered. Conversely, the assembly can be taken apart by that same person standing on the inside of the building, by reversing the assembly steps.

The corrugated sections, that is both the panel sections and the cover section, should be made of a sufficiently sturdy steel sheet metal or the like material which will resist a pre-determined level of impact which can be anticipated by wind-hurled or thrown objects in a storm found in that particular geographic area of the country where the building is located. The corrugated configurations of the sections resist the impact of wind-hurled or thrown objects. Moreover, as can be seen in FIG. 10, where the edge flanges 36 abut against the legs 23 of the adjacent panel sections, the forces of an impact against the exterior surface of the cover section will be transmitted to the adjacent panel sections through the edge flanges 36. Alternatively, the edge lips 24 of the panel sections can be of sufficient length to engage the angled legs of the corrugations of the center section. Where the panel sections are assembled, edge over edge, their adjacent lips and corrugation crowns are nested to form a double thickness composite which provides additional strength from destruction or penetration of the storm panel.

While the sections are disclosed as being formed of the particular shape corrugations described, that is a preferred embodiment and other types or shapes of corrugations may be utilized provided they have the desired strength to resist a pre-determined level of impact. Similarly, the fasteners, although shown of a particular type, which are preferred for this purpose, may be replaced by other mechanical fasteners which can be of the type that are easily manipulated and can be operated by a single person located on the inside of the building.

This invention may be further developed within the scope of the following claims. Accordingly, having described an operative, preferred embodiment, of this invention, I now claim:

1. A method of assembling a sectional storm panel assembly, from the interior of a building, over an opening having upper, lower and two side edges, comprising:

applying elongated rails along the upper and lower edges of the opening;

manually applying a plurality of substantially identical, vertically elongated, narrow sheet metal panel sections, each panel section having an interior surface and an exterior surface, one by one, over the opening by moving each panel section from the interior of the building through the opening and positioning each of the panel sections over the opening so that its upper and lower edges are arranged adjacent the respective upper and lower rails and its vertical side edges overlap the adjacent vertical side edges of the next adjacent panel section;

including applying the adjacent panel sections sequentially, starting from each of the two side edges of the opening towards the opposite side edge of the opening to form a pair of generally co-planar panel portions extending towards each other from the side edges of the opening and providing a gap, which extends from the upper to lower edge, between the portions;

manually fastening, from the interior of the building, the sections to at least one of the rails by mechanical fasteners, as the sections are applied;

closing the gap with a cover section having an interior and exterior surface and of approximately the same size and shape as the panel sections by manually inserting the cover section through the gap, from the interior of the building to the exterior, and manually positioning the cover section over the gap with the interior surface along the vertical edges of the cover section overlapping the adjacent exterior surface along the vertical side edges of the adjacent panel sections;

and manually fastening, from the interior of the building, with removable mechanical fasteners, the cover section to at least one of the rails.

2. A method as defined in claim 1, with the sections being corrugated in cross-section, and including positioning each of the sections so that its corrugations overlap the corrugations of the next adjacent section along their respective overlapped vertical edges of the sections.

3. A method as defined in claim 2, and including aligning in a common vertical plane, horizontally elongated strips formed on the upper and lower rails, and positioning the upper and lower edges of the sections to abut against the strip surfaces which face the building outside, and fastening the lower edges of the sections to the lower rail strip.

4. A method as defined in claim 1, and including providing an elongated rigid strip fastened and extending along the lower edge of the cover section, and positioning the rigid strip against the lower rail strip when the cover section is arranged over the gap, and manually securing, with removable mechanical fasteners, the rigid strip to the lower rail strip.

5. A sectional storm panel assembly for manually applying over a building opening having upper, lower, and side edges, from the inside of the building, comprising:

an upper rail fastened along the upper edge of the opening and a lower rail fastened along the lower edge of the opening, with the rails each having a horizontally elongated surface facing the outside of the building;

a plurality of substantially identical, vertical elongated, sheet metal panel sections, each panel section having an interior surface and exterior surface and arranged in generally co-planar, edge to edge relationship, forming a pair of panel portions, with each portion extending from one side edge of the opening towards the opposite side edge;

and the adjacent edges of the panel portions being spaced apart to form a vertical gap between the panel portions and extending from the upper to lower edge;

the lower edges of each of the panel sections being abutted against said lower rail and being secured by manually applied releasable fasteners to said lower rail, with the upper edges of the panel sections being abutted against the upper rail;

a cover section of generally the shape of the panel sections, having an interior and exterior surface and positioned across and covering the gap, and with its vertical side edges overlapping the exterior surfaces that face outside of the building of the adjacent, gap defining edges of the adjacent portions;

the lower edges of the cover section being secured by manually applied, releasable mechanical fasteners to the outside surface of the lower rail;

whereby the two panel portions may be manually assembled, section by section, by applying the sections, starting the assembly from the side edges of the opening towards the opposite side edges of the opening, until the panel portions are completed, with the gap formed between them, and the cover section may be inserted through the gap from the inside of the building to the outside and then positioned to cover the gap with its interior surface along the inside edges overlapping the adjacent exterior surface along the adjacent edges of the panel portions and the cover section may be fastened to the rail from the inside of the building so that the entire storm panel may be assembled over the building by a person located inside the building.

6. A sectional storm panel assembly as defined in claim 5, and including an elongated, rigid metal strip secured along the lower edge of the cover section;

and said mechanical fasteners securing the metal strip to the lower rail for fastening the lower edge of the cover section to the lower rail.

7. A sectional storm panel assembly as defined in claim 5, and with the upper rail being formed as a downwardly opening channel having an interior wall and an exterior wall and a base wall, and with the upper edge of the sections being arranged within the channel, but spaced downwardly from the base of the channel, and with the depth of the channel being sufficiently deep that each section may be lifted vertically upwardly within the channel towards the base of the channel a distance corresponding to the vertical height of the lower rail so as to pass over the lower rail and then lowered to abut against the surface of the lower rail that faces toward the outside of the building.

8. A sectional storm panel assembly as defined in claim 5, and including the lower rail having an upwardly extending, horizontally elongated, rigid strip for abutting against the lower edge of the respective sections, and the upper rail being formed as a downwardly opening channel into which the upper edges of the sections are fitted;

and the depth of the channel being sufficiently deep that each section may be inserted, vertically upwardly within the channel and lifted upwardly towards the base of the channel a distance corresponding to the vertical height of the lower rail strip so as to pass over the lower rail strip and then be lowered to abut against the outside surface of the lower rail, that is, the surface facing the outside of the building for thereby abutting said surface and being fastened thereto.

9. A sectional storm panel assembly as defined in claim 8, and said sections being vertically corrugated, and with the adjacent corrugated edge portions of each section overlapping the next adjacent corrugated edge portion of the next section;

and with the cover section being vertically corrugated similarly to the panel sections;

whereby impact loads applied against the cover section are transmitted to the adjacent panel section.

10. A sectional storm panel assembly as defined in claim 8, and said panel sections being vertically corrugated and the corrugated edge portions of each panel section overlapping and being nested within the adjacent corugated edge portion of the next adjacent panel section.

11. A sectional storm panel assembly as defined in claim 10, and including a manually engageable grip formed on the cover section's surface which faces inwardly of the building;

whereby the cover section grip may be manually grasped and the cover section may be manually lifted and moved into its assembly position by a person located in the inside of the building.

12. A sectional storm panel assembly as defined in claim 10, and with the lower rail being L-shaped in cross-section with one leg extending towards the upper edge of the opening to form the rigid strip for abutting against the lower of the sections.

13. A sectional storm panel assembly as defined in claim 12, and with the corrugations of the sections being formed, in cross-section, in generally truncated conical shapes, with the larger bases of the shapes being open and the smaller bases of the shapes being integral with the walls forming the truncated conical shapes, and with the smaller bases being arranged adjacent the lower rail surface which faces outwardly of the building.

14. A sectional storm panel assembly as defined in claim 13, and with the smaller bases, of the corrugated shapes, being bent into channels extending the full height of the sections for rigidifying the sections.

* * * * *